US008317143B1

(12) United States Patent
Abreu

(10) Patent No.: US 8,317,143 B1
(45) Date of Patent: Nov. 27, 2012

(54) ACCESSORY FOR SUSPENDING CONTAINERS FOR GREENERY

(76) Inventor: Barbaro Yordan Abreu, Miami, FL (US)

( * ) Notice: Subject to any disclaimer, the term of this patent is extended or adjusted under 35 U.S.C. 154(b) by 0 days.

(21) Appl. No.: 13/014,030

(22) Filed: Jan. 26, 2011

(51) Int. Cl.
*A47B 96/00* (2006.01)

(52) U.S. Cl. ..... 248/218.4; 248/230.9; 211/107

(58) Field of Classification Search ..... 248/218, 248/230.1, 230.8, 230.9, 311.2, 312, 315, 248/316.14, 218.4, 219.4, 222.14, 229.17, 248/316.1; 224/197, 271, 268, 269; 211/85.23, 211/107, 110, 113
See application file for complete search history.

(56) References Cited

U.S. PATENT DOCUMENTS 1,748,228 A * 2/1930 Jacobs ..... 211/107
3,332,654 A * 7/1967 Jacobson ..... 211/107
3,888,254 A * 6/1975 Hendricks ..... 604/387
3,888,354 A * 6/1975 Margolin et al. ..... 211/110
4,117,629 A * 10/1978 Ekdahl ..... 47/67
5,014,892 A * 5/1991 Copeland ..... 224/271
5,423,281 A * 6/1995 Crookham et al. ..... 248/230.9
6,390,427 B1 * 5/2002 McConnell et al. ..... 248/231.61
6,547,197 B2 * 4/2003 Kempf et al. ..... 248/218.4
6,588,440 B2 * 7/2003 Varnado ..... 248/218.4
6,752,365 B2 * 6/2004 Vanech ..... 248/218.4
7,458,475 B2 * 12/2008 Ho ..... 211/85.23
8,075,202 B1 * 12/2011 Chamberlayne ..... 224/197

* cited by examiner

*Primary Examiner* — Tan Le
(74) *Attorney, Agent, or Firm* — Albert Bordas, P.A.

(57) ABSTRACT

An accessory for suspending pots for flowers having a band assembly and at least one suspending assembly. The band assembly has a sidewall extending between a top edge and a bottom edge. The sidewall has at least one set of outwardly protruding sidewalls a predetermined distance from the sidewall to define a cavity. The at least one set of outwardly protruding sidewalls are connected by a front wall having a notched cutout. The band assembly is at a first predetermined angle when mounted. The at least one suspending assembly has an exterior wall, a neck, and a head. The neck fits within the notched cutout and the head fits within the cavity. The suspending assembly suspends a container having greenery. The at least one suspending assembly remains approximately in a second predetermined angle, which is approximately in a horizontal orientation regardless of the first predetermined angle.

11 Claims, 5 Drawing Sheets

ACCESSORY FOR SUSPENDING CONTAINERS FOR GREENERY

BACKGROUND OF THE INVENTION

1. Field of the Invention

The present invention relates to greenery accessories, and more particularly, to accessories that can be mounted onto tree trunks to suspend containers having greenery therein.

2. Description of the Related Art

Applicant is not aware of any device that may be mounted onto a tree truck that enables containers having greenery therein to be adjusted to a horizontal orientation regardless of the angle the device is in.

SUMMARY OF THE INVENTION

The instant invention is an accessory for suspending containers, comprising a band assembly and at least one suspending assembly.

The band assembly has a sidewall extending between a top edge and a bottom edge. The sidewall has at least one set of outwardly protruding sidewalls a predetermined distance from the sidewall to define a cavity. The at least one set of outwardly protruding sidewalls are connected by a front wall having a notched cutout. The band assembly is at a first predetermined angle when mounted. The at least one suspending assembly has an exterior wall, a neck, and a head. The neck fits within the notched cutout and the head fits within the cavity. The suspending assembly suspends a container comprising greenery.

The at least one suspending assembly remains approximately in a second predetermined angle. The second predetermined angle is an angle whereby the at least one suspending assembly is in an approximately horizontal orientation. The at least one suspending assembly remains approximately in a horizontal orientation regardless of the first predetermined angle. The neck rotates within the notched cutout to enable the at least one suspending assembly to remain approximately in the horizontal orientation regardless of the first predetermined angle of the band assembly.

The band assembly has first and second ends. The notched cutout is of a u-shaped configuration. The notched cutout comprises first and second notch edges and a base edge. The band assembly comprises at least one hole and at least one channel. The band assembly comprises locking means whereby the first end overlaps with the second end, or vice-versa. The locking means comprises a bolt and a wing nut. The container may comprise a step.

It is therefore one of the main objects of the present invention to provide an accessory for suspending containers that can be mounted to tree trunks, columns, or any other elongated structures.

It is another object of this invention to provide an accessory for suspending containers that comprises removable suspending assemblies of different sizes.

It is another object of this invention to provide an accessory for suspending containers that may be mounted onto a tree truck that enables containers having greenery therein to be adjusted to a horizontal orientation regardless of the angle the device is in.

It is another object of this invention to provide an accessory for suspending containers that can be readily assembled and disassembled without the need of any special tools.

It is another object of this invention to provide an accessory for suspending containers that is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
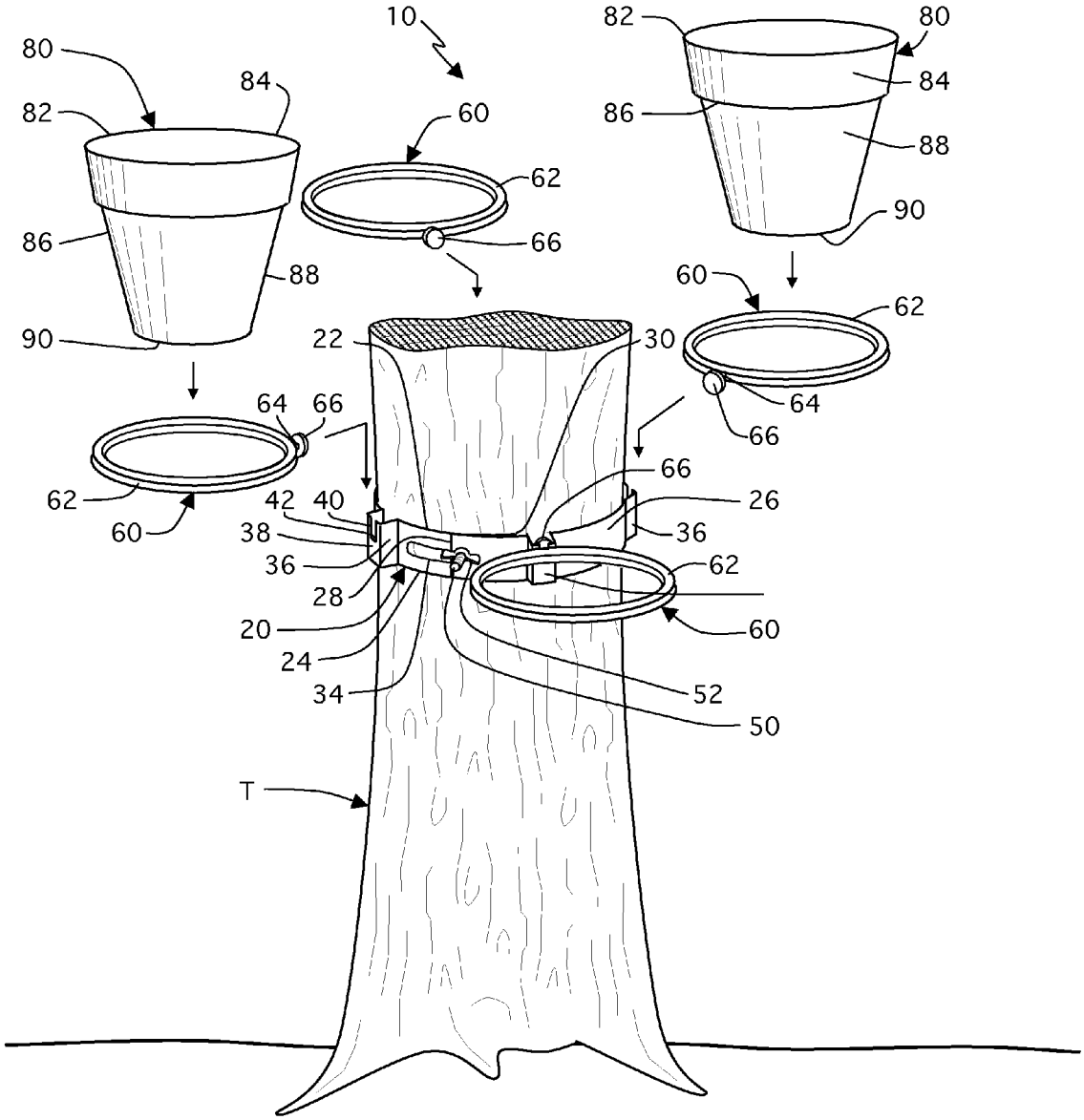
FIG. 1 represents an exploded isometric view of the instant invention.

Referring now to the drawings, the present invention is generally referred to with numeral 10. It can be observed that it basically includes band assembly 20 and suspending assemblies 60.

Figure 2:
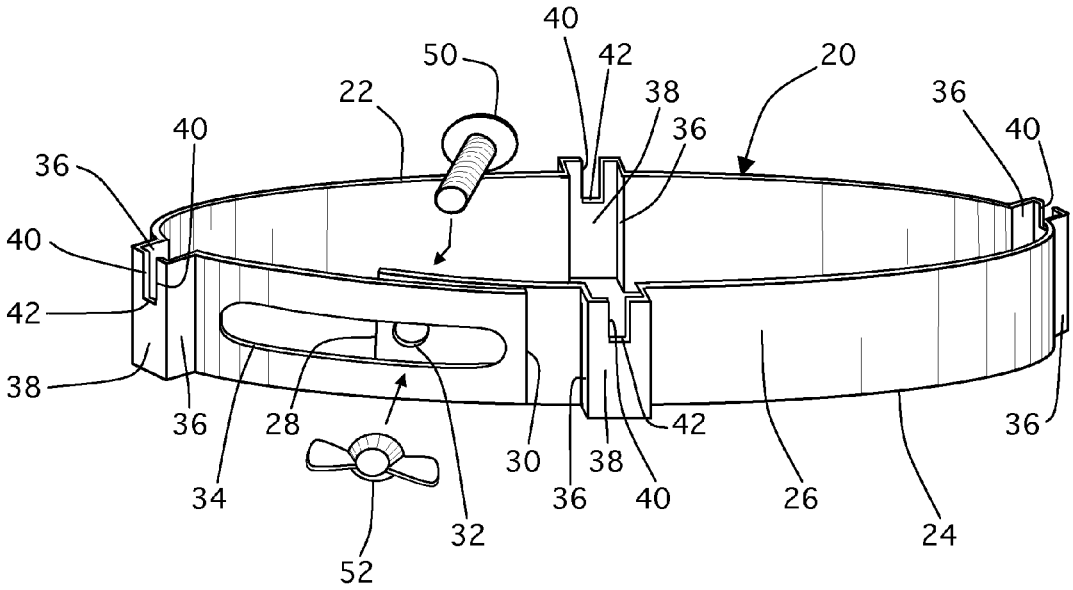
FIG. 2 is an isometric view of the band assembly showing an alternate assembly configuration.

As seen in FIG. 1, band assembly 20 is designed to secure around tree trunk T. In a preferred embodiment, band assembly 20 is circular in shape. However, band assembly 20 may be of any shape, including but not limited to, polygon, quadrilateral, square, triangle, rectangle, parallelogram, pentagon, hexagon, heptagon, and octagon. Band assembly 20 may also be mounted onto building and structure columns, erected poles, lamp-posts, or any other elongated erected structure. Band assembly 20 further has first and second ends 28 and 30 respectively, and comprises at least one hole 32, seen in FIG. 2, and at least one channel 34. Band assembly 20 comprises locking means whereby first end 28 overlaps with second end 30, or vice-versa as seen in FIG. 2, and the locking means may comprise bolt 50 and wing nut 52. Other locking means may also include a clamp assembly, screws and nuts, rivets, hook and loop fasteners, and others to secure band assembly 20 when mounted to tree trunk T.

Suspending assemblies 60 comprise exterior wall 62, neck 64, and head 66. Suspending assemblies 60 are geometrically designed to suspend pots 80. Suspending assemblies 60 may be of different sizes and shapes to accommodate different sizes and shapes of pots 80.

In a preferred embodiment, suspending assembly 60 is circular in shape. However, suspending assembly 60 may be of any shape, including but not limited to, polygon, quadrilateral, square, triangle, rectangle, parallelogram, pentagon, hexagon, heptagon, and octagon. Pots 80 are designed to contain greenery. Greenery is defined as any foliage of a plant, either live, freshly cut, or artificial for landscaping, interior design, and/or floral decoration. Foliage is defined as a representation of leaves, flowers, and branches for architectural ornamentation, or the aggregate of leaves of one or more plants, or a cluster of leaves, flowers, and branches. Pots 80 comprise top edge 82, sidewall 88, and base 90. Pots 80 may also comprise at least one sidewall 84 and/or step 86.

As best seen in FIG. 2, band assembly 20 has sidewall 26 extending between top edge 22 and bottom edge 24. Sidewall 26 has at least one set of outwardly protruding sidewalls 36 a predetermined distance from sidewall 26 to define a cavity. At least one set of outwardly protruding sidewalls 36 are connected by front wall 38 having a notched cutout. In a preferred embodiment, the notched cutout is of a u-shaped configuration and comprises first and second notch edges 40 and base edge 42. When mounted, band assembly 20 is at a first predetermined angle.

Figure 3A:
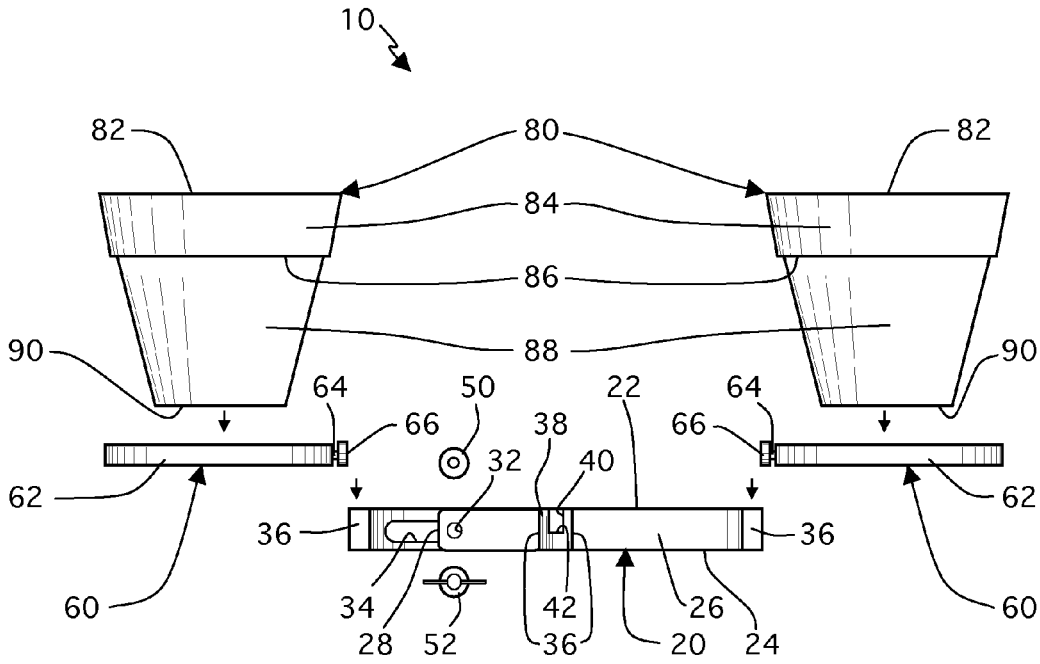
FIG. 3A is an exploded side elevational view of the instant invention.
Figure 3B:
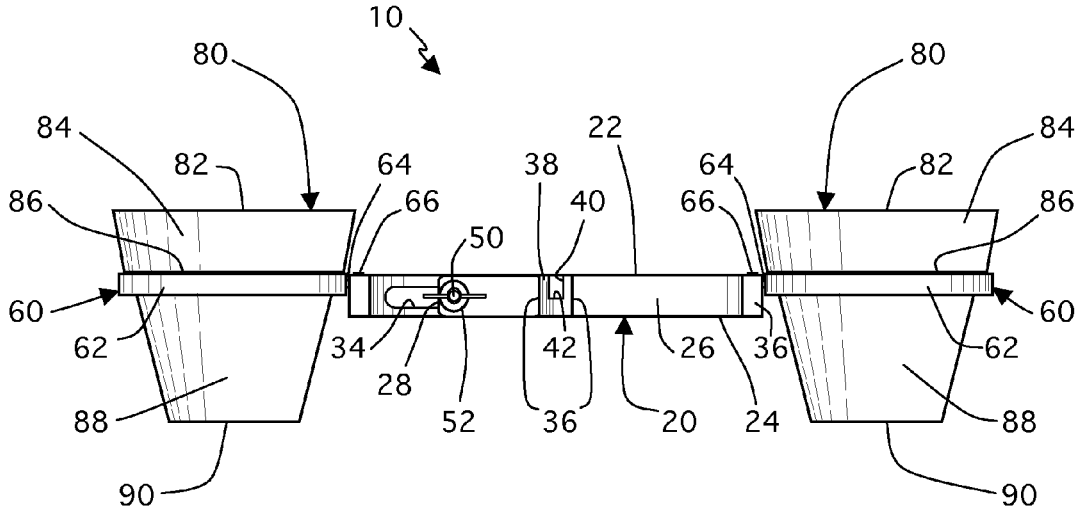
FIG. 3B is a side elevational view of the band assembly and the suspending assemblies secured thereon suspending pots.

As seen in FIGS. 3A and 3B, each suspending assembly 60 remains approximately in a second predetermined angle when secured onto band assembly 20. The second predetermined angle is an angle whereby suspending assembly 60 is in an approximately horizontal orientation.

Figure 4A:
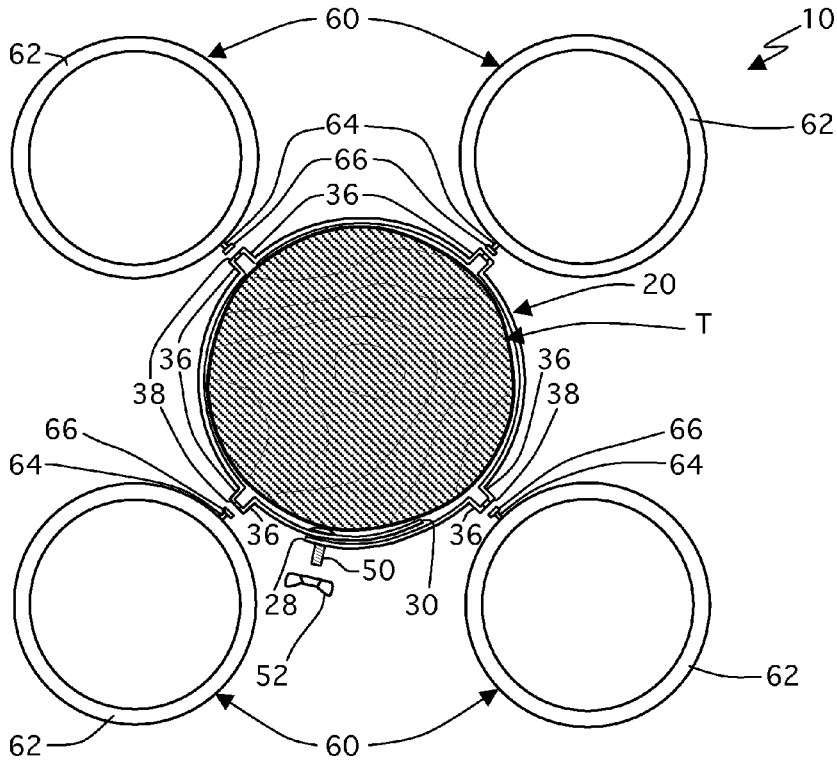
FIG. 4A is a top plan view of the band assembly mounted onto a tree trunk and suspending assemblies aligned to be secured thereon.
Figure 4B:
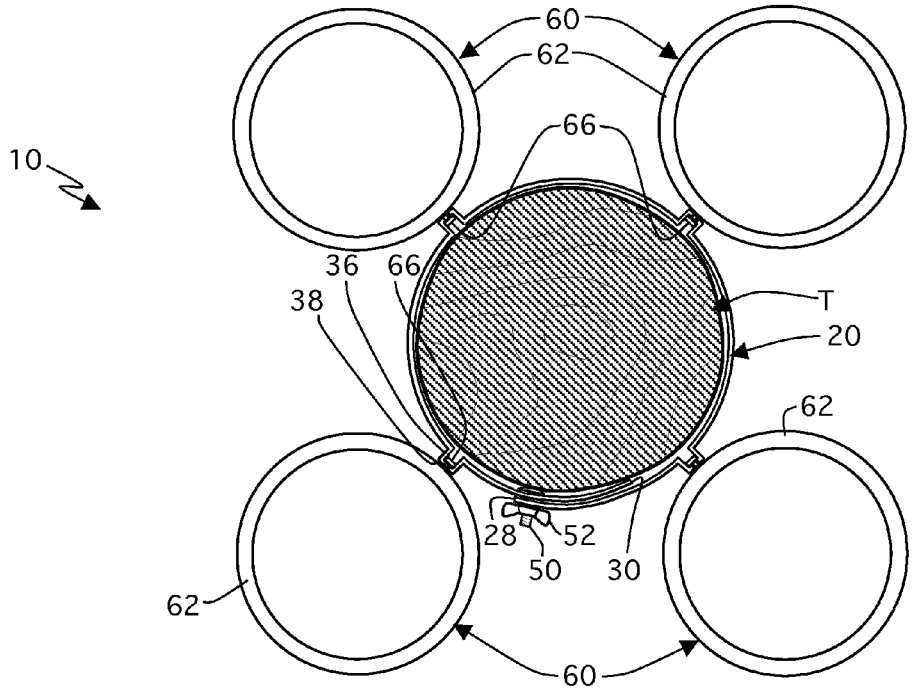
FIG. 4B is a top plan view of the band assembly mounted onto the tree trunk and the suspending assemblies secured thereon.

As seen in FIGS. 4A and 4B, neck 64 of each suspending assembly 60 fits within its respective notched cutout 40 and head 66 fits within the cavity.

Figure 5:
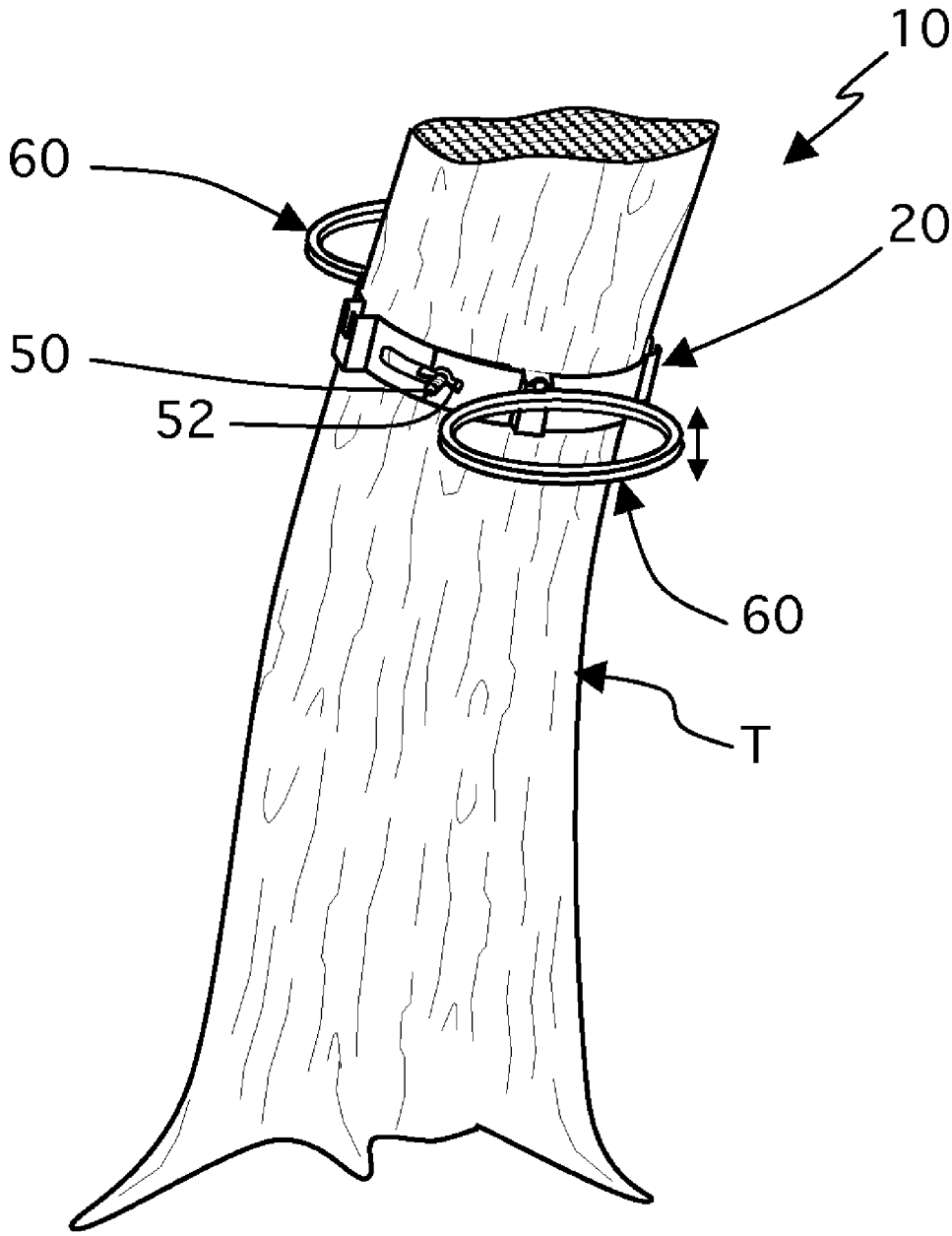
FIG. 5 is an isometric view of the band assembly mounted onto a slanted tree trunk and the suspending assemblies having been adjusted to a horizontal orientation.

As seen in FIG. 5, on many occasions tree trunk T grows at an angle and is not perfectly vertical. However, it is desired to position pots 60, containing the greenery, in a horizontal orientation. Therefore, each suspending assembly 60 is adjusted to remain approximately in a horizontal orientation regardless of the first predetermined angle of band assembly 20, whereby neck 64 rotates within the notched cutout to the desired orientation. Thus, enabling suspending assembly 60 to remain approximately in the horizontal orientation regardless of the first predetermined angle of band assembly 20.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An accessory for suspending containers, comprising:

A) an adjustable band assembly having first and second ends and a sidewall extending between a top edge and a bottom edge, said sidewall having at least one set of outwardly protruding sidewalls a first predetermined distance from said sidewall to define a cavity, said at least one set of outwardly protruding sidewalls connected by a front wall having a notched cutout, said adjustable band assembly is at a first predetermined angle, said adjustable band assembly further comprises locking means whereby said first end overlaps with said second end or vice-versa, said adjustable band assembly further comprises at least one hole and at least one channel, said at least one channel is a second predetermined distance from said first end and extends towards but does not reach said second end, said locking means comprises a bolt and a wing nut, said bolt and said wing nut are fixed at said at least one hole and said at least one channel; and B) at least one suspending assembly having an exterior wall, a neck, and a head, said neck fits within said notched cutout and said head fits within said cavity.

2. The accessory for suspending containers set forth in claim 1, further characterized in that said at least one suspending assembly remains approximately in a second predetermined angle.

3. The accessory for suspending containers set forth in claim 2, further characterized in that said second predetermined angle is an angle whereby said at least one suspending assembly is in an approximately horizontal orientation.

4. The accessory for suspending containers set forth in claim 1, further characterized in that said at least one suspending assembly remains approximately in a horizontal orientation regardless of said first predetermined angle.

5. The accessory for suspending containers set forth in claim 1, further characterized in that said neck rotates within said notched cutout to enable said at least one suspending assembly to remain approximately in a horizontal orientation regardless of said first predetermined angle of said adjustable band assembly.

6. The accessory for suspending containers set forth in claim 1, further characterized in that said notched cutout is of a u-shaped configuration.

7. The accessory for suspending containers set forth in claim 6, further characterized in that said notched cutout comprises straight first and second notch edges and a base edge.

8. An accessory for suspending containers, comprising:

A) an adjustable band assembly having first and second ends and a sidewall extending between a top edge and a bottom edge, said sidewall having at least one set of outwardly protruding sidewalls a first predetermined distance from said sidewall to define a cavity, said at least one set of outwardly protruding sidewalls connected by a front wall having a notched cutout, said adjustable band assembly at a first predetermined angle, said adjustable band assembly further comprises locking means whereby said first end overlaps with said second end or vice-versa, said adjustable band assembly further comprises at least one hole and at least one channel, said at least one channel is a second predetermined distance from said at least one hole and extends towards but does not reach said second end, said locking means comprises a bolt and a wing nut, said bolt and said wing nut are fixed at said at least one hole and said at least one channel; and B) at least one suspending assembly having an exterior wall, a neck, and a head, said neck fits within said notched cutout and said head fits within said cavity, said at least one suspending assembly remains approximately in a second predetermined angle that is approximately in a horizontal orientation regardless of said first predetermined angle.

9. The accessory for suspending containers set forth in claim 8, further characterized in that said neck rotates within said notched cutout.

10. The accessory for suspending containers set forth in claim 8, further characterized in that said notched cutout is of a u-shaped configuration.

11. The accessory for suspending containers set forth in claim 10, further characterized in that said notched cutout comprises straight first and second notch edges and a base edge.

* * * * *